US012338698B2

(12) United States Patent
Shearer et al.

(10) Patent No.: US 12,338,698 B2
(45) Date of Patent: Jun. 24, 2025

(54) METHODS AND SYSTEMS ASSOCIATED WITH WIRELINE PRESSURE CONTROL

(71) Applicant: GREENWELL ENGINEERING LLC, Weatherford, TX (US)

(72) Inventors: Gary Shearer, Flint, TX (US); Chris Reed, Canton, TX (US)

(73) Assignee: Greenwell Engineering, LLC, Weatherford, TX (US)

( * ) Notice: Subject to any disclaimer, the term of this patent is extended or adjusted under 35 U.S.C. 154(b) by 0 days.

(21) Appl. No.: 18/736,810

(22) Filed: Jun. 7, 2024

(65) Prior Publication Data

US 2024/0410243 A1 Dec. 12, 2024

Related U.S. Application Data

(60) Provisional application No. 63/472,019, filed on Jun. 9, 2023.

(51) Int. Cl.

| | |
|---|---|
| ***E21B 33/068*** | (2006.01) |
| ***E21B 23/14*** | (2006.01) |
| ***E21B 34/02*** | (2006.01) |

(52) U.S. Cl.
CPC ..... *E21B 23/14* (2013.01); *E21B 33/068* (2013.01); *E21B 34/02* (2013.01)

(58) Field of Classification Search
CPC ..... E21B 33/068
See application file for complete search history.

(56) References Cited

U.S. PATENT DOCUMENTS

| | | | | |
|---|---|---|---|---|
| 4,928,522 | A * | 5/1990 | Tonnelli | E21B 47/11 166/252.6 |
| 8,689,879 | B2 * | 4/2014 | Patel | E21B 33/047 166/348 |
| 9,169,714 | B2 * | 10/2015 | Edwards | E21B 33/076 |
| 10,240,433 | B2 * | 3/2019 | Osaland | E21B 27/02 |
| 2015/0285392 | A1 * | 10/2015 | Hunt | F16K 1/38 137/488 |
| 2017/0204702 | A1 * | 7/2017 | Hansen | E21B 33/068 |
| 2024/0247755 | A1 * | 7/2024 | Johnson | E21B 33/068 |

* cited by examiner

*Primary Examiner* — Matthew R Buck

(57) ABSTRACT

A lubricator vent sub is placed at a lowest point in a greasehead with maximum volume to relieve trapped air, wherein the lubricator vent sub creates a secondary flow path for the trapped air.

14 Claims, 3 Drawing Sheets

METHODS AND SYSTEMS ASSOCIATED WITH WIRELINE PRESSURE CONTROL

BACKGROUND INFORMATION

Field of the Disclosure

Examples of the present disclosure relate to systems and methods associated with a device to ventilate trapped air while priming and pressure testing a lubricator. More specifically, embodiments are directed towards a lubricator vent sub that is placed at the highest point in a lubricator stack with maximum flow area to relieve trapped air, wherein the lubricator vent sub creates a flow path for the displaced air when priming a lubricator, prior to entering a grease injection control head or greaseless packoff.

Background

In the oil and gas industry, the term wireline broadly defines industry-specific methods, processes, and technologies that lower tools and other equipment into a wellbore, via a cable or wire. The cables or wires, known as wirelines, are strong, thin lengths of wire or braided cable mounted on a power reel. Wireline activities are vital for oilfield operations and are essential to oil and gas exploration. The term pressure control broadly defines industry specific methods, processes and technologies that enable the wireline to be conveyed in and out of the wellbore without exposing wellbore pressure to the atmosphere. Pressure control devices used on the top of the lubricator are called grease injection control heads, grease heads, packoffs, greaseless packoffs, etc., each represents a different method and technology to prevent wellbore fluids from escaping. Those skilled in the art will recognize they are not interchangeable, however for this background the term grease head will be used to represent all these technologies.

Conventionally, wireline tools are initially exposed to the wellbore by being hoisted into a lubricator stack capped with a pressure control device at atmospheric pressure and then connected to the well. Subsequently, the lubricator is filled with water to a specific pressure for a system integrity pressure test. When the pressure testing commences, air can become trapped below the grease head as water is added to fill the lubricator. Pressurizing the trapped air at fast rates causes the air to be superheated. Conventionally, this superheated air flows upward through the grease head. This superheating of the air can cause the wireline to burn, which can melt the insulation around the conductor resulting in a shorted line, and/or sever the line and drop the tool string on the well valve.

Currently, to relieve the trapped air, hydraulically activated devices within the grease head open and close a port using a packoff pump. However, a number of moving parts can clog the port, which does not allow the port to close resulting in a leak. Additionally, the placement of these parts within the flow tube section of a grease head does not allow for proper ventilation of the trapped air and causes the superheated air to directly interface with the wireline.

Accordingly, needs exist for systems and methods for a lubricator vent sub that creates a flow path outside of the flow tube to relieve the trapped air, wherein the lubricator vent sub is positioned at the top of the lubricator stack, before the grease head flow tube sections, while pressure testing the lubricator.

SUMMARY

Embodiments disclosed herein describe systems and methods associated with a lubricator vent sub to ventilate trapped air pressure while pressurizing a lubricator. In embodiments, a wireline may be positioned within a lubricator positioned above a well, wherein air can get trapped at the top of the lubricator stack. During pressurization of the lubricator, the bottom of the lubricator may be filled with fluid. As the lubricator is being filled with the fluid, the fluid, acting as a piston, displaces air to the top of the lubricator stack, pressurizing the entire lubricator stack. The displaced air may move into an inlet of the lubricator vent sub, into an annulus of the lubricator vent sub, into an inlet of a valve assembly, across a valve, and out of an outlet of the valve assembly wherein the outlet of the valve assembly is positioned above a distal end of the wireline and the annulus is positioned between an outer diameter of the flow tube and an inner diameter of the lubricator vent sub. The positioning of the outlet of the valve assembly at a higher point than the distal end of the wireline may limit the ability of the air to be compressed within the lubricator stack, which could burn the wireline. Furthermore, the positioning and relative sizing of the outlet may allow for the air to be displaced out of the valve assembly at high speeds, which creates a very efficient process to relieve the otherwise trapped air. After it is determined that water is flowing out of the outlet, it may be determined that all of the trapped air has been relieved. Subsequently, the valve within the valve assembly may be closed. In embodiments, by removing the trapped air, pressurizing the lubricator can occur much quicker while improving safety.

Embodiments may include a grease head or greaseless packoff, flow tube(s), wellhead, wireline, lubricator, tool string, and lubricator vent sub.

The grease head may be a grease injector that is the main apparatus for controlling well pressure while running into and out of the hole. The grease head may utilize a series of flow tubes to decrease the pressure head of the well before reaching the distal end of the packoff. Additionally, the grease head is used to inject grease at high pressure into the bottom portion of the grease head to counteract the well pressure.

The flow tube may be a tubular that is configured to receive the wireline. For example, the flow tube may be the flow tubes described in U.S. 63/443,409. The flowtube may be configured to provide protection to the wireline during a superheating event. While the wireline is positioned within the flow tube, a fluid seal may be formed in an annulus between the outer diameter of the wireline and the inner diameter of the flow tube. In embodiments, the grease head may be configured to inject grease into the annulus void between the flow tube and the wireline cable. In embodiments, a flow path may be created between an outer diameter of the flow tube and an inner diameter of the lubricator vent sub to an inlet of the valve assembly. The flow path may allow displaced air to bypass the flow tube, such that the displaced air does not interact with the wireline within the flow tube. In embodiments, the flow tubes may be formed of material with a lower conductive heat rate than the lubricator vent sub or other external body, wherein the material of the flow tube may be configured to aid in heat rejection away from the wireline. The flow tubes may be a standard industry length for interchangeability or may be a shorter length to maximize a space inside the lubricator stack to reduce any ancillary height requirements of supporting equipment.

The lubricator may be a thick wall pipe fitted to the top of the wellhead or Christmas tree so that tools may be put into a high-pressure well. The top of the lubricator may be coupled to a grease head or greaseless packoff. The tools placed in the lubricator, and the lubricator, may be installed on top of the wellhead and pressure tested. In embodiments, the lubricator may be initially filled with air. However, to equalize the lubricator it may be necessary to fill the lubricator with fluid. When filling the lubricator with fluid, the air initially within the lubricator may be displaced and pressurized by the fluid being injected into the lubricator, wherein the fluid acts as a piston to move the compressed air upward within the lubricator towards the lubricator vent sub.

The wellhead may be equipment installed at the surface of a completed oil or gas well that provides a structural pressure containing interface for the drilling, completion and production equipment. In other words, the wellhead may be installed after the casing is terminated.

The wireline may be a multi-conductor, single conductor, or slickline cable used as a conveyance for the acquisition of subsurface data, and the delivery of well construction services, such as perforating, plug setting, well cleaning, and fishing.

The downhole tool may be a tubular that extends down through the lubricator. An upper end of the tool may be coupled to a distal end of the wireline, and the lower end of the tool may be positioned within the lubricator. In embodiments, the downhole tool may be positioned below a water level.

The lubricator vent sub may be a device coupled to the grease head or greaseless packoff to receive the displaced air bypassing the flow tube within the grease head, which may relieve the displaced air that is pressurized when filling the lubricator. The lubricator vent sub may include a lubricator connector, valve assembly, and a grease injection port. An inlet of the lubricator vent sub may be configured to receive superheated air from the lubricator, create a flow path between a flow tube and an inlet of the valve assembly.

The lubricator connector may be configured to couple the lubricator vent sub to the lubricator.

The valve assembly may include an inlet, valve, and outlet. The pressured air may move into an inlet of the lubricator vent sub, into the annulus between the flow tube and the inner diameter of the lubricator vent sub, into an inlet of the valve assembly, across the valve, and out of an outlet of the valve assembly, wherein the outlet of the valve assembly is positioned above a distal end of the wireline. The positioning of the outlet of the lubricator vent sub at a higher point than the distal end of the wireline may limit the ability of the air to be compressed within the lubricator stack to burn the wireline. In embodiments, the valve may include an open/close indicator and a pressure sensor, wherein the valve may open or close to maintain a minimum pressure drop value across the flow path between a distal end of the exposed wireline and the outlet. The indicator may be configured to indicate whether the valve is open or closed, and the pressure sensor may be configured to monitor pressure at the valve. By monitoring pressure at the valve, there may be a built-in safeguard for opening the valve if pressure is present while opening the valve. In specific embodiments, the valve may be monitored and controlled electronically and may include a safety mechanism of automatically closing upon determining a significant wellbore pressure at the valve when the valve is open.

These, and other aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions, or rearrangements may be made within the scope of the invention, and the invention includes all such substitutions, modifications, additions, or rearrangements.

BRIEF DESCRIPTION OF THE DRAWINGS

Non-limiting and non-exhaustive embodiments of the present invention are described concerning the following figures, wherein reference numerals refer to like parts throughout the various views unless otherwise specified.

Figure 1:
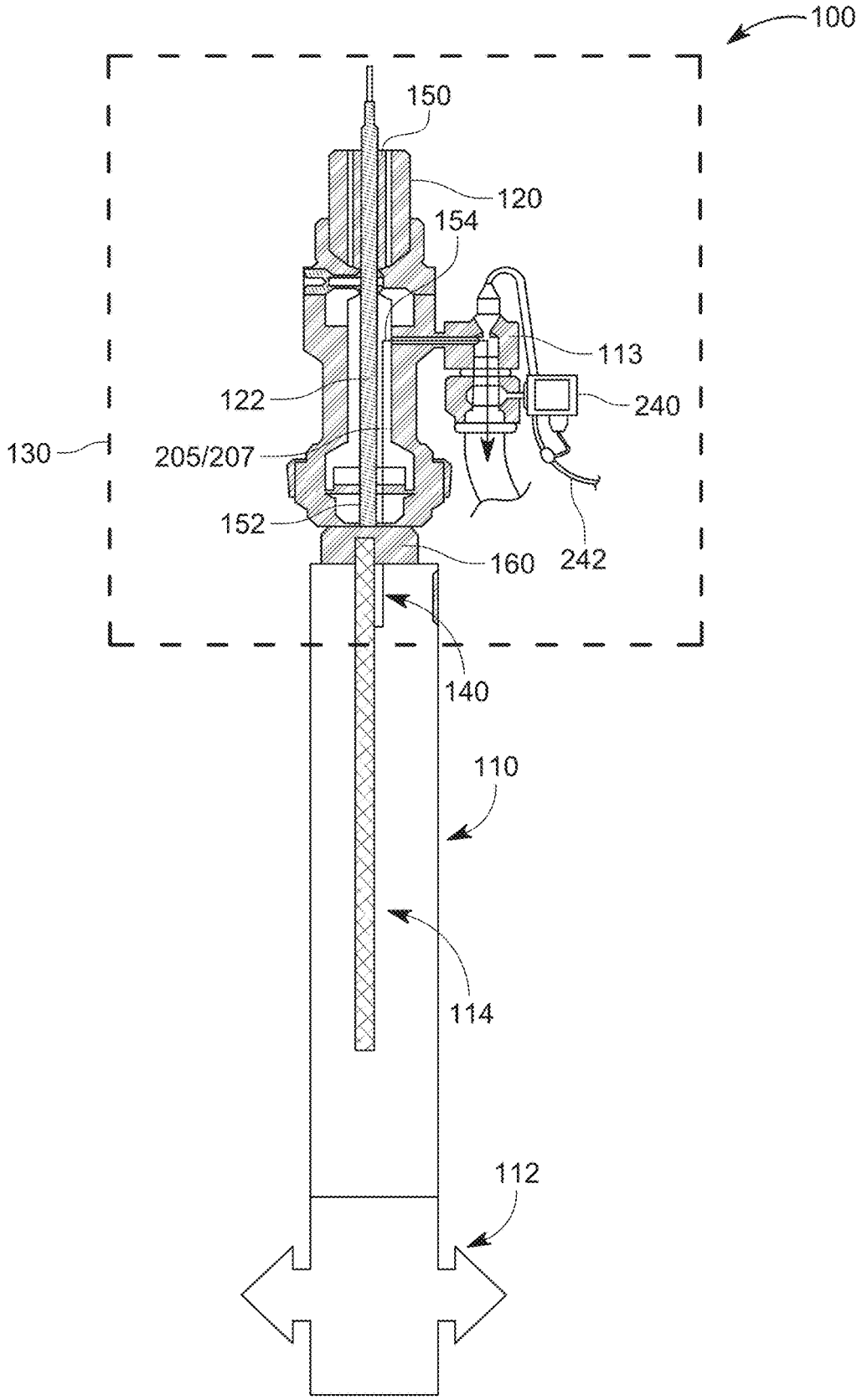
FIG. 1 depicts a lubricator vent sub that is configured to vent displaced air to prime a lubricator for pressuring testing, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well understood elements that are useful or necessary in a commercially feasible embodiment are often not depicted to facilitate a less obstructed view of these various embodiments of the present disclosure.

DETAILED DESCRIPTION

In the following description, numerous specific details are outlined in order to provide a thorough understanding of the present invention. It will be apparent, however, to one having ordinary skill in the art that the specific detail need not be employed to practice the present invention. In other instances, well-known materials or methods have not been described in detail to avoid obscuring the present invention.

FIG. 1 depicts lubricator vent sub system 100 that is configured to vent displaced air to prime a lubricator for pressuring testing, according to an embodiment. By removing the displaced air, the air may never be superheated which may allow pressure testing of the lubricator to occur much quicker while improving safety. System 100 may include a grease head 120, wellhead 112, wireline 122, lubricator 110, downhole tool 114, and lubricator vent sub 130.

Grease head 120 may be a grease injector that is the main apparatus for controlling well pressure, wherein portions of grease head 120 may form portions of lubricator vent sub 130. Grease head 120 may utilize a series of flow tubes to decrease the pressure head of the well before reaching the distal end of a packoff, wherein the packoff may be positioned above the grease head 120. Additionally, the grease head 120 injects grease at high pressure into the bottom portion of the grease head 120 to counteract the well pressure. In embodiments, wireline 122 may be configured to be inserted within a flow tube in grease head 122, wherein the flow tube may be a tubular that is configured to receive wireline 122. For example, the flow tube may be the flow tubes described in U.S. 63/443,409. Grease head 120 may have a proximal end 150, distal end 152, and vent port 154. Vent port 154 may be positioned vertically between proximal end 150 and distal end 152, which is above a water level 160.

Wireline 122 may be an electric line, multi-conductor, single conductor, or slickline cable as a conveyance for the acquisition of subsurface data, and the delivery of well construction services, such as perforating, plug setting, well cleaning, and fishing. While wireline 122 is positioned within the flow tubes, a fluid seal may be formed in an annulus between the outer diameter of wireline 122 and the inner diameter of the flowtubes. In embodiments, the lubricator 110 may be configured to inject grease into the annulus void between the flowtubes and the wireline 122. Wireline 122 may be configured to be inserted through grease head 120 through substantially a central axis of grease head 120, wherein a flow path 140 may be created along an axis offset from the central axis of grease head 120 and the lubricator vent sub 130. Flow path 140 may allow displaced pressurized air, and subsequently water, to bypass the wireline 122 and flow upward along flow path 140.

Lubricator 110 may be a thick-walled body fitted to the top of the wellhead 112 or Christmas tree so that tools may be put into a high-pressure well. A top of lubricator 110 may be coupled to grease head 120 or greaseless packoff, with a bottom of lubricator 110 installed on top of the wellhead 112, wherein lubricator 110 is subsequently equalized and pressurized. In embodiments, downhole tools 114 may be placed in the lubricator 110, and lubricator 110 may be pressurized to wellbore pressure. Lubricator 110 may be initially filled with air. However, to equalize lubricator 110 it may be necessary to fill the lubricator 110 with water. When filling lubricator 110 with water via wellhead 112, the air initially within lubricator 110 may be pressurized by the water being injected into lubricator 110. The water may act as a piston to move the air upward within lubricator 110 towards the lubricator vent sub 130. In embodiments, the air may move through flow path 140, around the flow tube in lubricator vent sub 130.

Wellhead 112 may be equipment installed at the surface of a completed oil or gas well that provides a structural pressure containing interface for the drilling and production equipment. In other words, wellhead 112 may be installed after the casing is terminated. In embodiments, wellhead 112 may be configured to inject water into the bottom of the lubricator 110 to equalize and pressurize the lubricator 110.

Downhole tool 114 may be a tubular that extends down through the lubricator. An upper end of tool 114 may be coupled to a distal end of the wireline 122, and the lower end of tool 114 may be positioned within the lubricator 110. In embodiments, the tool may be positioned below a water level 160.

Lubricator vent sub 130 may be an assembly positioned between a lubricator and a grease head 120. Lubricator vent sub 130 may include grease head 120 and valve assembly 113. Valve assembly 113 may be a device coupled to the grease head 120 to provide a secondary flow path 140 to relieve compressed air that is pressurized when pressure testing the lubricator 110. In embodiments, when pressurizing lubricator 110, water may be injected into a distal end of lubricator 110, which may push air within lubricator 110 upward. Conventionally, this air is compressed and superheated within grease head 120 when pressurizing lubricator 110. When utilizing conventional methods, the superheated air may burn and damage wireline 122 at the location between the upper end of lubricator 110 and the lower end of the flow tube. However, valve assembly 113 may provide a release for secondary flow path 140 that allows air to travel out of lubricator vent sub 130 via vent port 154 into valve assembly 113. The displaced air may move into an inlet of the lubricator vent sub 130, into an annulus of the lubricator vent sub 130, into an valve assembly 113 via vent port 154, across a valve within valve assembly 113, and out of an outlet of the valve assembly 113 wherein the outlet of the valve assembly 113 is positioned above a distal end of the wireline 122 and the annulus 207 is positioned between an outer diameter of a flow tube 205 and an inner diameter of the lubricator vent sub 130. The positioning of the outlet of the valve assembly 113 at a higher point than the distal end of the wireline 122 may limit the ability of the air to be compressed within the lubricator stack, which could burn the wireline 122.

Figure 2:
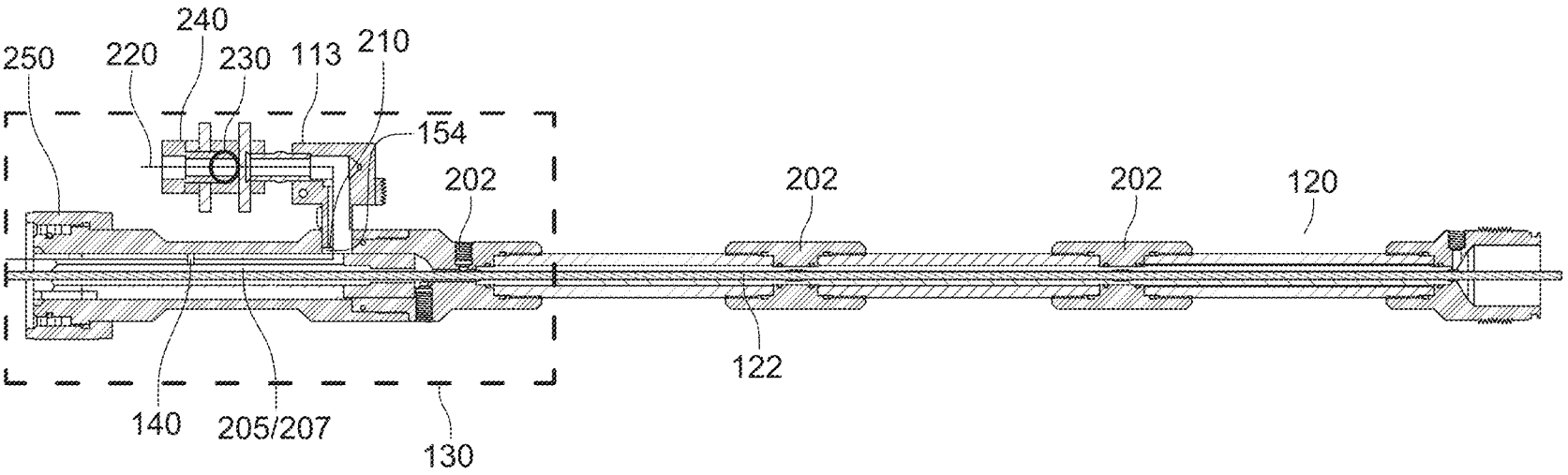
FIG. 2 depicts a detailed view of a lubricator vent sub, according to an embodiment.

FIG. 2 depicts a detailed view of lubricator vent sub 130, according to an embodiment. Elements depicted in FIG. 2 may be described above, and for the sake of brevity, a further description of these elements may be omitted.

As depicted in FIG. 2, lubricator vent sub 130 may be placed at the highest point in a lubricator stack with maximum flow area to relieve trapped air, or at the lowest point of grease head 120. In embodiments, a distal end of lubricator vent sub 130 may be coupled to the lubricator via lubricator connection 250. Lubricator connection 250 may be configured to receive the displaced air that is caused by pressurizing the lubricator. A proximal end of the lubricator vent sub 130 may be formed by the distal end of the grease head 120. In embodiments, grease head 120 may include a series of grease ports 202, and a proximal end of grease head 120 may be coupled to a packoff.

In embodiments, air may be pushed upward from lubricator 110 into lubricator connection 250, flow within an annulus 207 between an outer diameter of flow tube 205 and an inner diameter of lubricator vent sub 130. The air may subsequently flow into an inlet of valve assembly 113 via port 154. In embodiments, inlet 210 may be positioned vertically higher than the distal end of wireline 122 and the distal end of flow tube 205. Furthermore, inlet 210 may be positioned on the first side of valve 230.

Outlet 220 may be positioned on the second side of valve 230 and may be configured to receive the pressurized air flowing into valve assembly 113 when valve 230 is open. Outlet 220 may be configured to vent the pressurized air at a location that is vertically higher than the distal end of wireline 122 and the distal end of the flow tube 205. In embodiments, outlet 220 may be positioned vertically lower than inlet 210, which may assist in venting the pressurized air. The positioning of outlet 220 at a higher point than the distal end of the wireline 122 may limit the ability of the air to be compressed within the lubricator stack to burn wireline 122. In embodiments, once all the pressurized air is vented, fluid may flow out of outlet 220 from lubricator 110 via flow path 140 if valve 230 is open. In embodiments, a cross-sectional area or diameter of outlet 220 may be twice the size of the cross-sectional area of inlet 210, which will allow faster air release. For example, inlet 210 may be a half inch in diameter, whereas outlet 220 may be one inch in diameter.

Valve 230 may be a ball valve or any other flow control device. Valve 230 may include a hollow, perforated, and pivoting ball to control fluid flowing through it. When valve 230 is opened, the hollow passageway may be in line with the faces of inlet 210 and outlet 220. When valve 230 is closed, the hollow passageway may be orthogonal to the faces of inlet 210 and outlet 220. In embodiments, Valve 230 may include an open/close indicator and a pressure sensor 242. The indicator may be configured to indicate whether the valve is open or closed, and the pressure sensor 242 may be configured to monitor pressure at valve 230. By monitoring pressure at valve 230, there may be built-in safeguard for opening valve 230 if pressure is present while opening the valve. Controller 240 may be an electronic actuator configured to open and close valve 230 which can be controlled and monitored wirelessly or via a wired connection. In embodiments, controller 240 may include pressure transducers, sensors 242, etc. that are positioned in relation to the valve 230 be able to continuously read lubricator pressure within grease head 120.

Figure 3:
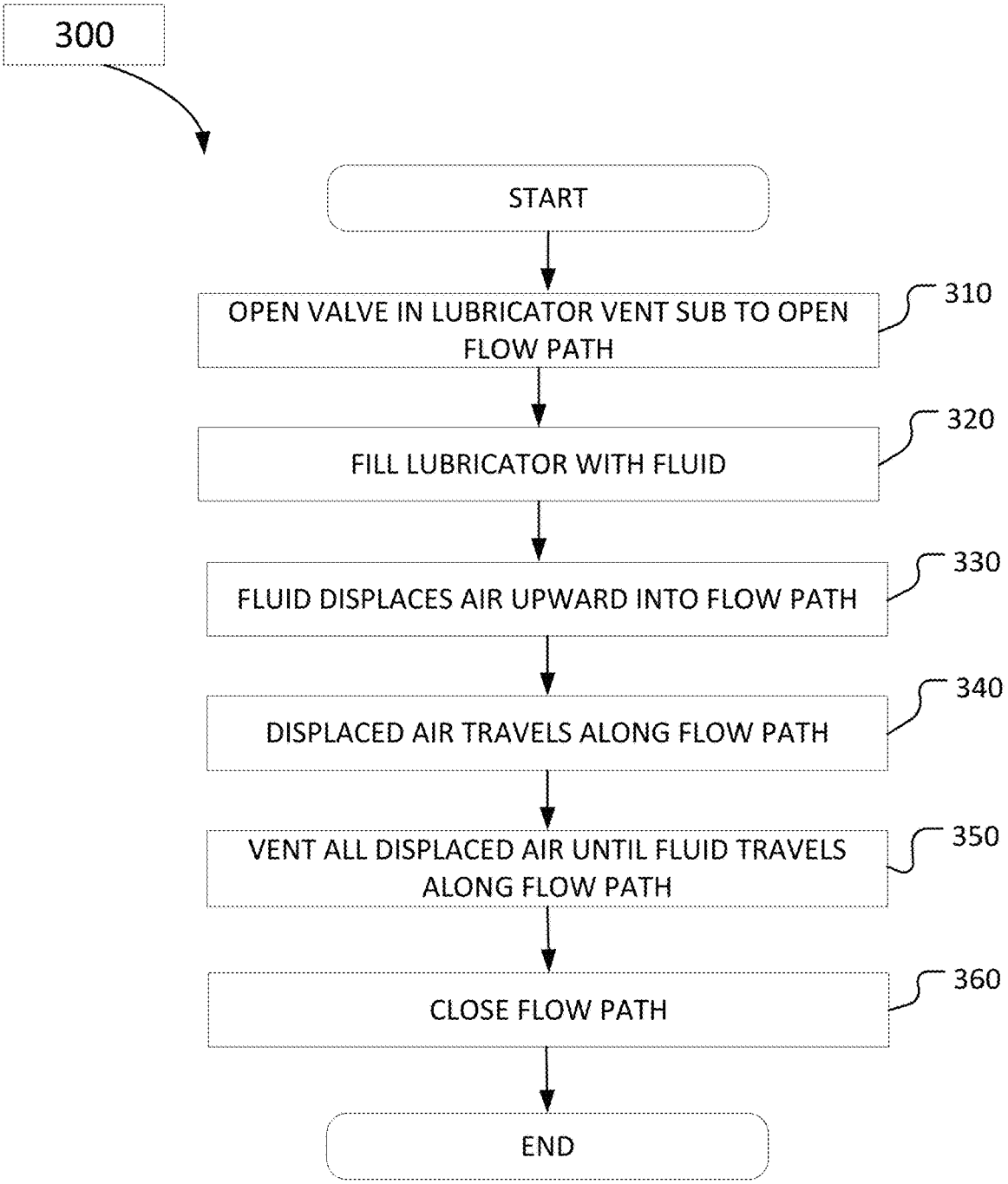
FIG. 3 depicts an operation sequence utilizing a lubricator vent sub to vent air while priming a lubricator, according to an embodiment.

FIG. 3 depicts an operation sequence utilizing a lubricator vent sub to vent air while pressurizing a lubricator, according to an embodiment. The operational sequence presented below is intended to be illustrative. In some embodiments, operational sequence may be accomplished with one or more additional operations not described, and/or without one or more of the operations discussed. Additionally, the order in which the operations of the operational sequence are illustrated in FIG. 3 and described below is not intended to be limiting.

At operation 310, a valve within a lubricator vent sub may be opened. By opening the valve, a flow path from inside a lubricator to an outlet positioned above a distal end of the wireline may be created. Specifically, the flow path may extend from the lubricator to an annulus within a grease head, wherein the annulus is positioned between an outer diameter of a flow tube within the grease head and an inner diameter of the grease head. The flow path may continue to an inlet of the a valve assembly, across the valve, and to the outlet.

At operation 320, a wellhead positioned below the lubricator may inject water within a distal end of the lubricator to pressurize the lubricator.

At operation 330, responsive to receiving the fluid within the lubricator, the water may act as a piston to displace air that was previously positioned within the lubricator. Specifically, the water may move the air upward into the flow path.

At operation 340, the displaced air may move along and out of the flow path.

At operation 350, all of the displaced air may move along the flow path, and water may be emitted out of the outlet within the lubricator vent sub. When water is emitted out of the outlet, it may indicate that the lubricator is equalized.

At operation 360, the valve within the lubricator vent sub may be closed.

Although the present technology has been described in detail for illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

Reference throughout this specification to "one embodiment", "an embodiment", "one example" or "an example" means that a particular feature, structure, or characteristic described in connection with the embodiment or example is included in at least one embodiment of the present invention.

Thus, appearances of the phrases "in one embodiment", "in an embodiment", "one example" or "an example" in various places throughout this specification are not necessarily all referring to the same embodiment or example. Furthermore, the particular features, structures, or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

What is claimed is:

1. A system associated with wireline pressure control comprising:

a grease head or greaseless packoff;

a lubricator vent sub coupled to the grease head or greaseless packoff and having an inlet, a valve, and an outlet, the inlet being configured to receive pressurized air, wherein the pressurized air travels along a flow path, the flow path flowing through an annulus between an outer diameter of a flow tube and an inner diameter of the lubricator vent sub to the inlet, the inlet being positioned on a first side of the valve, the outlet being positioned on a second side of the valve, the outlet being configured to receive the pressurized air when the valve is opened, the outlet being positioned vertically higher than a distal end of a lubricator connection.

2. The system of claim 1, further comprising:

a lubricator coupled to the lubricator vent sub and installed on top of a wellhead, wherein the lubricator is initially filled with air and subsequently filled with fluid, wherein the pressurized air is created when the lubricator is filled with the fluid.

3. The system of claim 2, wherein the flow path of the pressurized air is from a position inside of the lubricator into the annulus, to the inlet, across the valve, and to the outlet.

4. The system of claim 3, wherein the flow path bypasses a wireline.

5. The system of claim 1, further comprising:

a pressure sensor located at the valve configured to monitor pressure at the valve, wherein the pressure sensor is configured to continuously read lubricator pressure.

6. The system of claim 5, further comprising:

a controller configured to wirelessly open and close the valve, wherein the controller is configured to automatically close the valve responsive to determining that a wellbore pressure at the valve is above a threshold when the valve is open.

7. The system of claim 1, wherein the lubricator vent sub is positioned on top of a lubricator while pressurizing the lubricator.

8. The system of claim 1, wherein a first cross-sectional area of the inlet is half a second cross-sectional area of the outlet.

9. The system of claim 1, wherein a minimum pressure drop along the flow path from an exposed distal end of a wireline to the outlet is maintained.

10. The system of claim 1, wherein the lubricator vent sub further comprises one or more flowtubes to protect the wireline during a superheating event.

11. The system of claim 10, wherein the flowtubes are formed of a first material, and the lubricator vent sub is formed of a second material, the first material having a lower conductive heat rating than the second material.

12. The system of claim 11, wherein the first material is configured to aid in heat rejection away from the wireline.

13. The system of claim 10, wherein the flowtubes are standard industry length.

14. The system of claim 10, wherein the flowtubes are shorter than standard industry length.

* * * * *